United States Patent [19]

Rodriguez

[11] Patent Number: 4,757,950

[45] Date of Patent: Jul. 19, 1988

[54] APPARATUS AND METHOD FOR CUTTING AND SPOOLING A WEB OF PAPER

[75] Inventor: Peter A. Rodriguez, Atlantic Beach, Fla.

[73] Assignee: Sandar Industries, Inc., Jacksonville, Fla.

[21] Appl. No.: 87,875

[22] Filed: Aug. 21, 1987

[51] Int. Cl.[4] ..... B65H 19/20; B65H 18/16; B65H 75/28

[52] U.S. Cl. ..... 242/56 R; 242/65; 242/74

[58] Field of Search ..... 242/56 R, 64, 65, 74; 428/294, 295; 83/542

[56] References Cited

U.S. PATENT DOCUMENTS

| | | | |
|---|---|---|---|
| 2,343,047 | 2/1944 | Doyle et al. | 242/56 R |
| 2,461,246 | 2/1949 | Weyenberg | 242/56 R |
| 3,599,888 | 8/1971 | Coudriet et al. | 156/174 X |
| 3,765,615 | 9/1973 | Brink et al. | 242/56 R |
| 4,414,258 | 11/1983 | Corbin, Sr. | 242/74 X |
| 4,659,029 | 4/1987 | Rodriguez | 242/56 R |

*Primary Examiner*—Stuart S. Levy
*Assistant Examiner*—Steven M. Dubois
*Attorney, Agent, or Firm*—Arthur G. Yeager

[57] ABSTRACT

An apparatus and method for cutting a travelling paper web 20 winding on a spool 24 and transferring the web 20 onto an empty spool 27 by attaching a cutting tape to the empty spool 27, including a repulpable paper fiber stiff tape 30 passing through an elongated guideway 34 from near end 38 to far end 36; the apparatus and method characterized by:

(1) adding adhesive to one surface of the tape 30;

(2) gripping the tape 30 adjacent its leading end after it has exited from the guideway 34; and (3) releasing the tape 30 at a selected time and permitting the leading end 37 to move forward into contact with the nip 29 between empty spool 27 and driving roll 23.

14 Claims, 4 Drawing Sheets

27
23
29
20
37
42
41
39
45
46
54
44
43
47
48
51
30
36
34

27
41
42
39
46
45
37
47
29
43
48
51
54
30
36
20
23
34

Fig.8
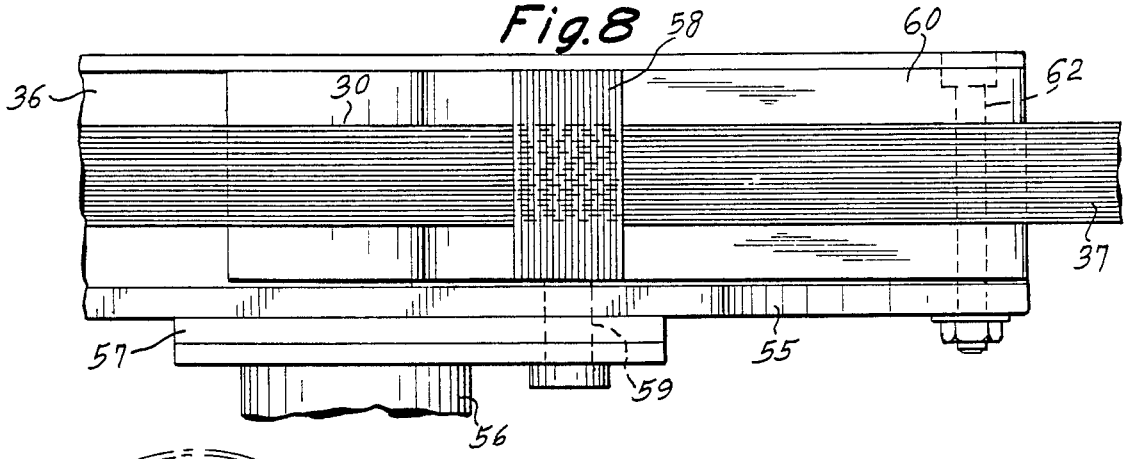
Fig.9
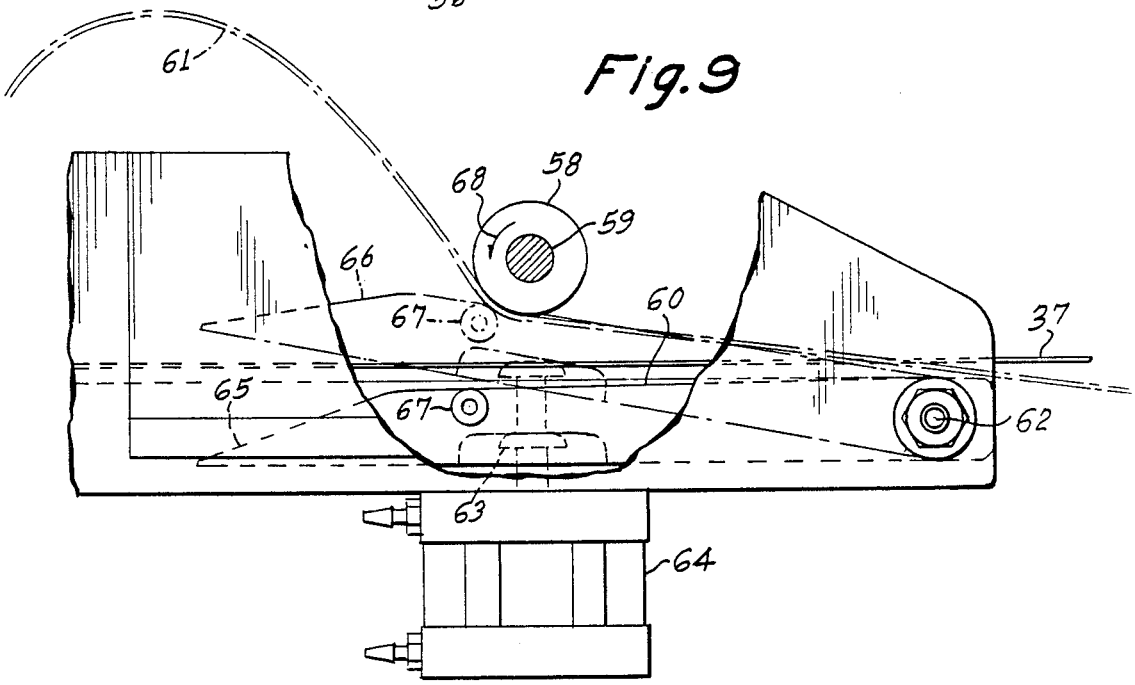
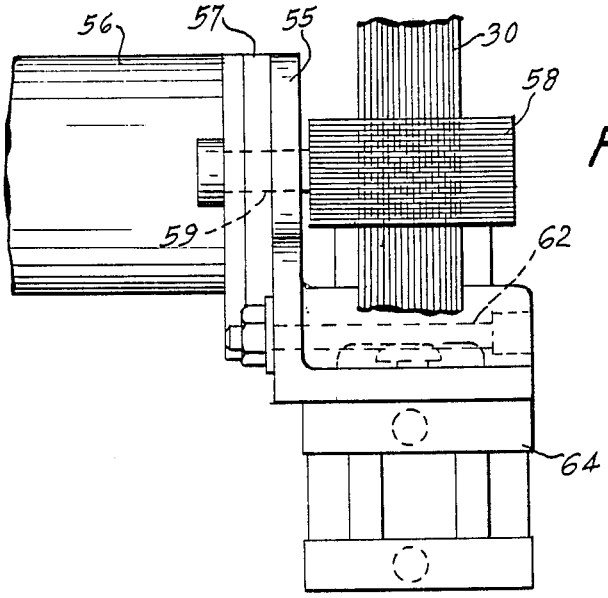
Fig.10

APPARATUS AND METHOD FOR CUTTING AND SPOOLING A WEB OF PAPER

TECHNICAL FIELD

This invention relates to an apparatus and method for cutting a travelling web of paper being wound on one spool and transferring the web to an empty spool while the web is travelling.

BACKGROUND ART

It is a general practice in the paper industry to produce a continuous sheet or web of paper which is wound onto large spools. In order to have a continuous operation it is, of course, necessary to have a system for instantaneously switching from winding the web of paper onto a full roll to an empty roll, particularly at modern speeds of paper production. In U.S. Pat. No. 2,461,246 there is shown a method of feeding a tape onto the rotating empty roll core and causing it to be spirally wrapped on that core as it stretches tight across the travelling web of paper and cuts the paper, with the cut edge being led onto the empty roll supported by the cutting tape. Subsequent improvements have dealt with methods of stringing the tape for cutting and feeding, and the use of various types of tapes, as shown for example in U.S. Pat. No. 4,414,258 where there is described a tape made of repulpable paper woven into a tape which did not interfere with the paper making process since the paper wound adjacent the roll is waste and is recycled. The most recent improvement is disclosed in my U.S. Pat. No. 4,659,029 which describes the use of a repulpable paper fiber tape in an elongated guideway to direct the tape under a travelling web of paper and direct the tape into the nip of an empty spool so as to cut the web of paper and start it rolling onto the empty spool.

It is an object of this invention to provide an improvement in feeding the tape onto the empty spool. It is another object to provide such a system that can be operated from a remote control so as to avoid any possibility of interfering with the travelling web of paper. Other objects will appear from the more detailed description which follows.

BRIEF DESCRIPTION OF THE INVENTION

This invention relates to a system for cutting with a tape, a travelling web of paper, being wound on a first spool and transferring that travelling web onto an empty spool by attaching said tape to said empty spool, said tape travelling slidingly through a guideway with an elongated slot facing upwardly underneath said web and exiting from said guideway beyond the edge of the web; the improvement which comprises a clamping means for releasably gripping said tape adjacent the forward end to prevent movement of the tape after said forward end has exited from said guideway; and selectively releasing said clamping means to permit forward movement of said forward end into the nip between said empty spool and the cooperating roller driving said empty spool.

This invention also relates to an improved method for cutting a travelling web of paper being wound on a spool and transferring the web after cutting to an empty spool, the method including a cutting tape being fed into an elongated guideway positioned beneath and extending laterally across the web of paper, recovering the tape from the far end of the guideway and introducing it into the nip of the empty spool and the roller driving that spool to cause the tape automatically to spirally wrap around the empty spool while cutting the web of paper; wherein the improvement comprises the steps of:

(1) feeding said tape into a guideway;

(2) receiving the tape leaving the far end of the guideway into a remotely controlled clamping means;

(3) gripping the tape near its forward end by said clamping means with said forward end extending beyond said clamping means; and (4) releasing said clamping means and moving said forward end of said tape into contact with said nip.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 8 is a top plan view of an alternate clamping means;

FIG. 9 is a side elevational view of the clamping means of FIG. 8;

FIG. 10 is a front elevational view of the clamping means of FIG. 8.

DETAILED DESCRIPTION AND BEST MODE OF THE INVENTION

Figure 1:
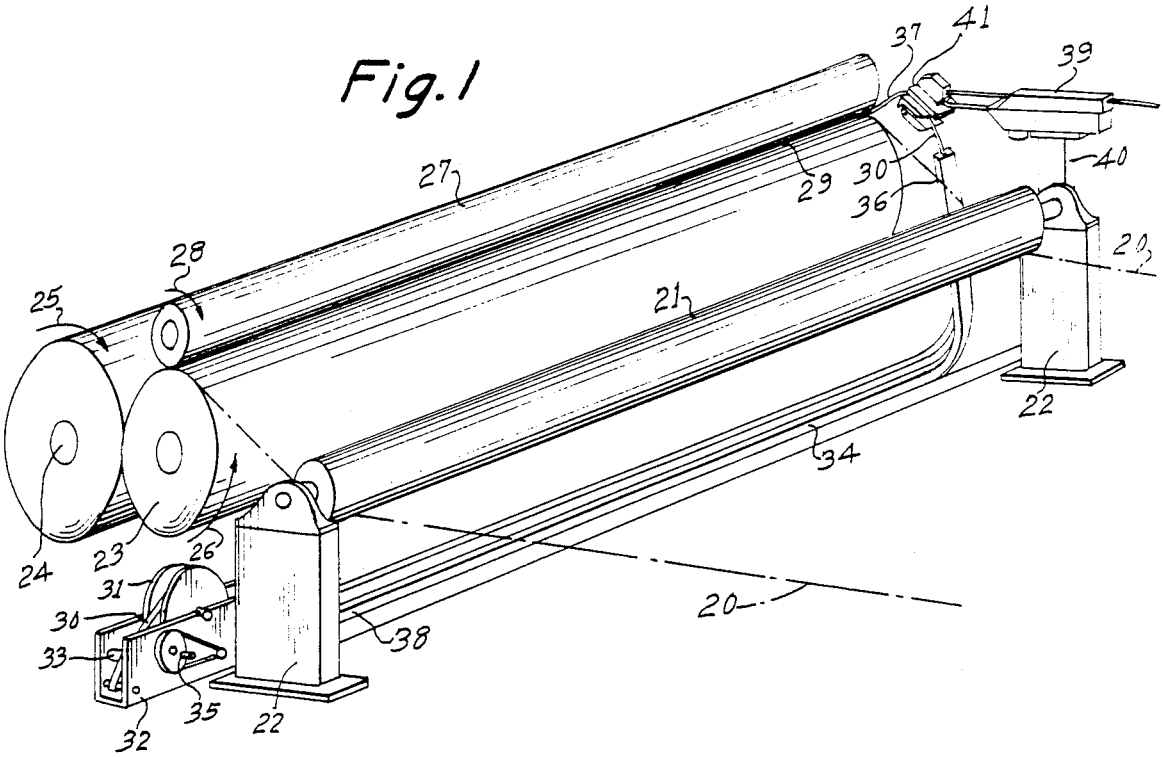
FIG. 1 is a perspective view of the system of rollers employed in the paper industry to wind the paper web onto rolls, and the present apparatus used to transfer the leading edge of the web to an empty spool in accord with this invention.
Figure 11:
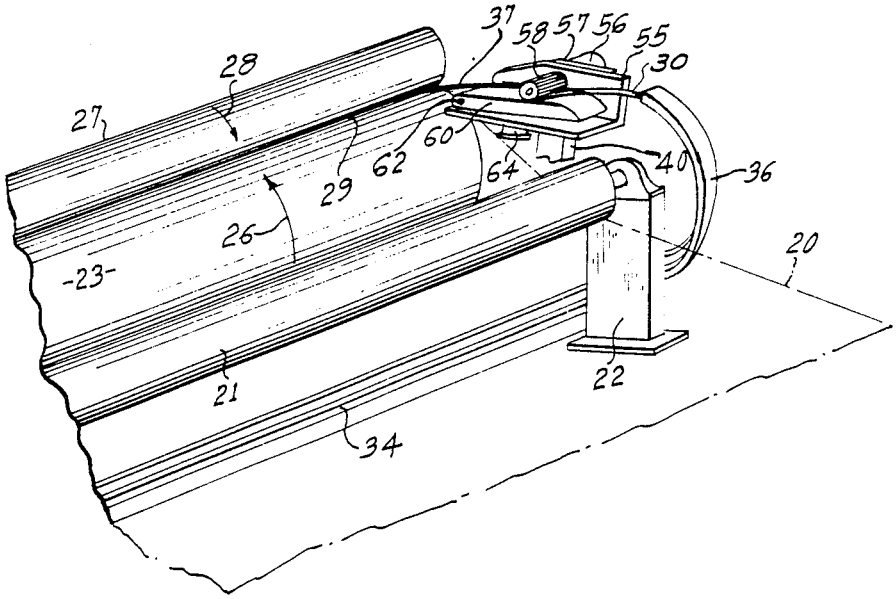
FIG. 11 is a partial perspective view showing the alternate clamping means of FIGS. 8–10 as it would be used in a system of rolls in the paper industry.

The general features of this invention are best seen and understood by reference to FIG. 1 which shows the general type of equipment employed in a paper manufacturing plant to wind up the manufactured paper on rolls for storage and use elsewhere. A continuous web of paper 20 travels at a relatively rapid rate of speed to a combination of spools upon which the paper is rolled. Paper web 20 advances toward tension roll 21 mounted in journals on supports 22, leading web 20 over driving roll 23 and winding about spool 24 turning in the direction of arrow 25. Driving roll 23 turns in the direction of arrow 26 and is pressed against the paper roll on spool 24 causing it to rotate in the indicated direction.

When spool 24 has been filled to the desired capacity with paper from web 20, it is necessary to cut web 20 laterally, transfer the cut edge to an empty spool 27, and start the web winding on that spool in the direction of arrow 28 to eventually produce another filled spool, such as spool 24. Empty spool 27 is positioned vertically above the location shown in FIG. 1 until it is ready to accept paper from web 20 and begin winding it up. Empty spool 27 is caused to rotate so as to accept the cut edge of web 20. This may be accomplished by lowering spool 27 until it contacts driving roll 23 as shown in FIG. 1. The cut edge of web 20 is then introduced into the nip 29 between empty spool 27 and driving roll 23 to cause a transfer of the paper web thereto.

The apparatus of this invention generally includes a means for supplying a tape to the far edge of empty spool 27 and causing that tape to wrap around spool 27 in a spiral fashion so as to cut web 20 and cause the cut edge to be introduced onto spool 27 and be wrapped about spool 27. A supply of cutting tape 30 is preferably maintained on a removable drum 31 in a housing 32 which, at the appropriate time, cuts tape 30 from the large supply on drum 31. It will be appreciated that only a definite length of tape, longer than the width of web 20, is needed to cut across web 20 laterally and to cause the cut edge to begin wrapping itself upon empty spool 27, and thus at the appropriate place tape 30 is cut and further tape is not needed until spool 27 becomes filled with paper and must be replaced by another empty spool. Tape 30 passes through a cutting means 33 and into a guideway 34 propelled by a driving means which may be a hand crank 35 or motorized propelling means (which may be programmed by computer means) to cause the free end of tape 30 to move completely across the width of web 20 underneath that web in guideway 34 until it reaches the far end 36 where the free end 37 of tape 30 is made available to be inserted into nip 29 between spool 27 and driving roll 23. An adhesive is applied to tape 30 at free end 37 so that when it is introduced into nip 29 it will adhere to the surface of empty spool 27. Preferably the adhesive is applied to free end 37 of tape 30 before it enters guideway 34 so it may be serviced and maintained on the operator's side of the travelling web 20. Forward end 37 of tape 30 emerges from far end 36 of guideway 34 and is gripped by a clamping means and held immovable until the operator is ready to cut the travelling web 20 and start wind up on a new roll 27. Then the forward end 37, with adhesive coating on the side facing roll 27, is advanced into nip 29. One type of clamping means involves a mechanical arm 39 which is mounted on a standard 40 and has a hand, or clamping means 41 which grips tape 30, and on command extends hand 41 toward nip 29 until tape 30 is caught in nip 29 and is adhered to the surface of empty spool 27. A frictional resistance is then applied to the tape 30 adjacent near end 38, e.g., the frictional resistance produced when tape 30 is dislodged from guideway 34, causing the tape 30 to spiral across the length of empty spool 27 and cut through web 20 as it does so and causes a transference of web 20 onto empty spool 27.

Figure 2:
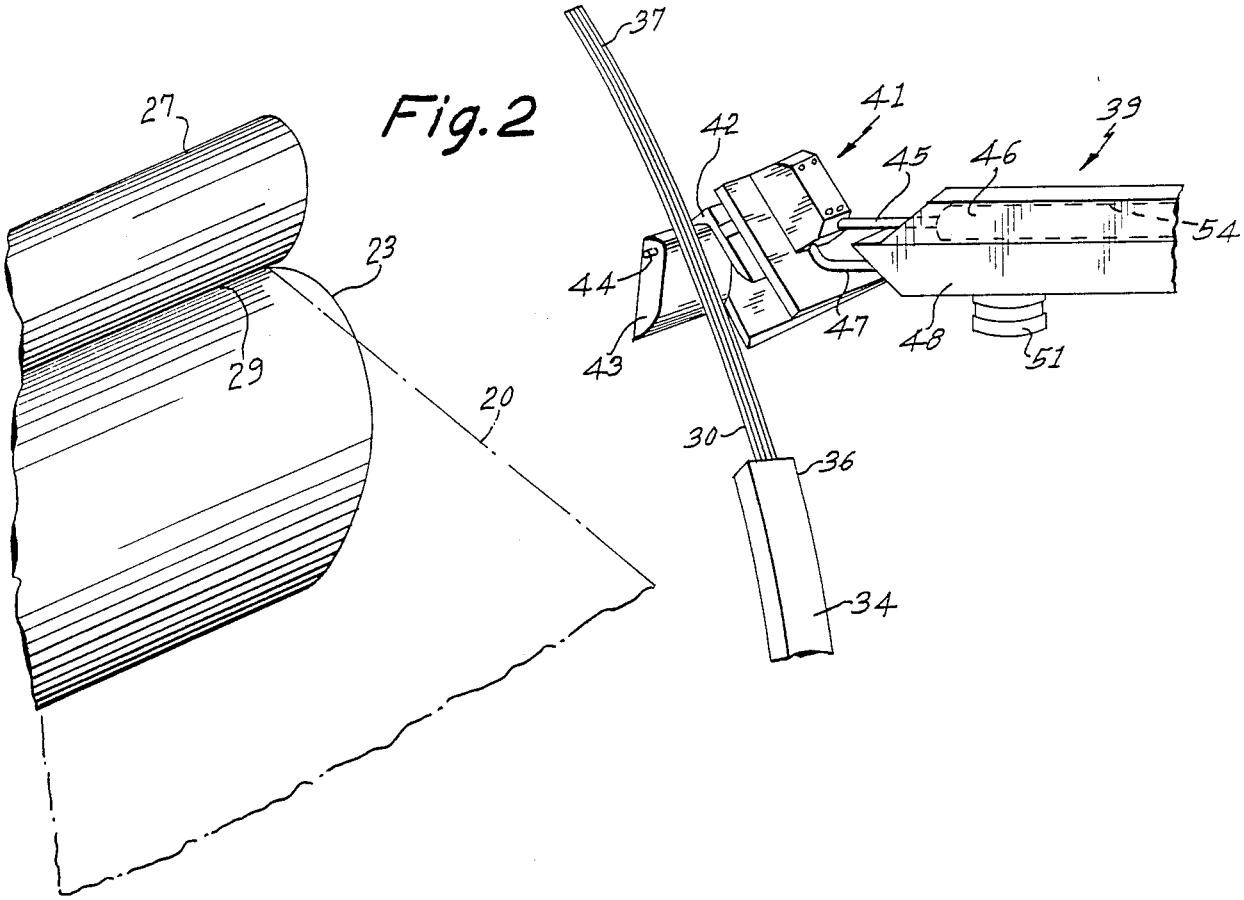
FIG. 2 is an enlarged perspective view of a mechanical arm gripping the leading end of the tape.
Figure 3:
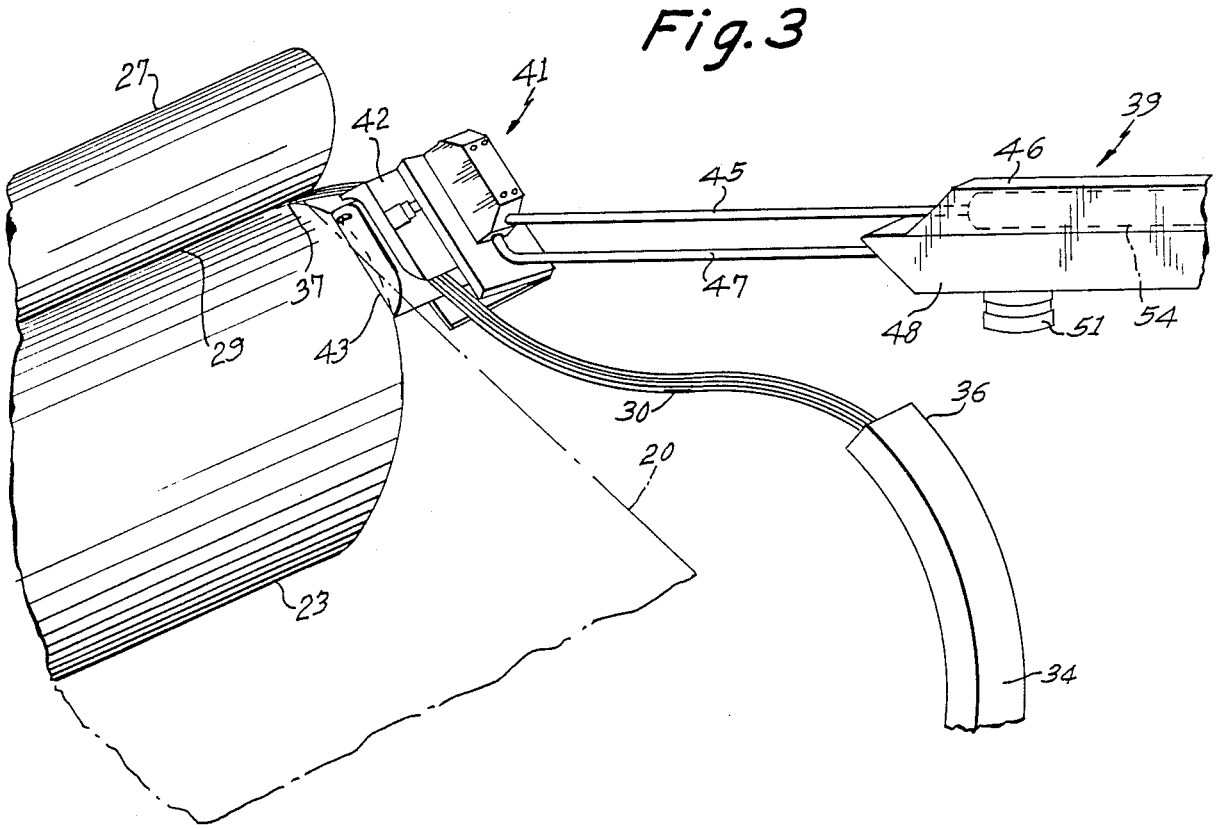
FIG. 3 is an enlarged perspective view of the mechanical arm of FIG. 2 extended to present the tape to the nip of the empty spool and the roller driving that empty spool.
Figure 4:
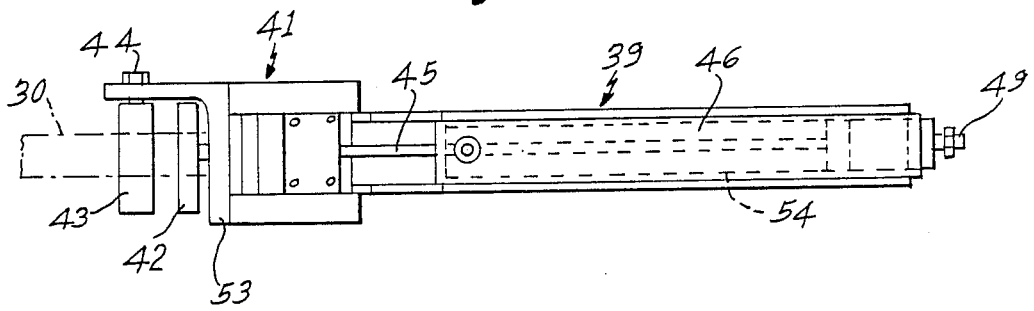
FIG. 4 is a top plan view of a mechanical arm which can be used in this invention.
Figure 5:
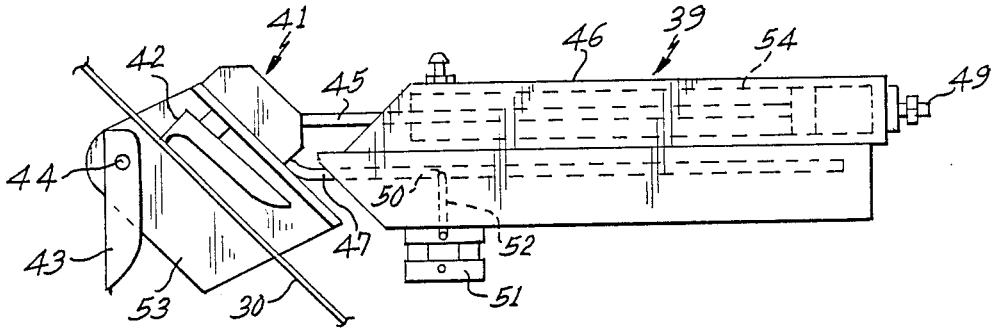
FIG. 5 is a front elevational view of the mechanical arm shown in FIG. 4.

In FIGS. 2 and 3 there are shown the actions of the mechanical arm 39 in receiving tape 30 and placing it in the nip 29 of empty spool 27 and driving roll 23 to cause the simultaneous cutting of web 20 and transference of the leading cut edge of web 20 to be rolled up on empty spool 27. Mechanical hand or clamping means 41 includes a movable jaw 42 and a clamping member 43 which pivots about pin 44. Jaw 42 is attached to the end of connecting rod 45 which is extended or retracted by the action of an hydraulic cylinder or pneumatic cylinder 54 in housing 46. Clamping means 41 is attached to elongated rod 47 which selectively extends or retracts by the action of an hydraulic cylinder or pneumatic cylinder 54 in housing 48. When clamping means 41 is retracted and jaw 42 is retracted as in FIG. 2, clamping means 41 is positioned above far end 36 of guideway 34 so that as the forward end 37 of tape 30 projects outwardly from guideway 34 it passes between jaw 42 and clamping member 43. The cylinder 54 in housing 46 is then activated to cause connection rod 45 to extend outwardly pushing jaw 42 against clamping member 43, which pivots around pin 44 to allow jaw 42 and clamping member 43 to nest together gripping tape 30 between the two as shown in FIG. 3. A release mechanism in cylinder 51 is then tripped to permit elongated rod 47 to extend clamping means 41 toward spool 27 and roll 23. When forward end 37 of tape 30 contacts nip 29, the adhesive coating on end 37 to empty spool 27 and begins to be wrapped around spool 27 as it turns. This causes tape 30 to slice through the edge of web 20 and to continue to cut across the entire width of web 20 as tape 39 is wrapped spirally onto spool 27. The oncoming web 20, behind the cut is automatically led to empty spool 27 by tape 30 as it is wrapped thereupon. When tape 30 is caught by nip 29 and is wrapped upon spool 27, tape 30 is released by clamping means 41 and also is pulled out of guideway 34. A certain amount of frictional resistance is needed to maintain tension on tape 30 so it will cut web 20. This frictional resistance may be provided in part by means of a brake applied to the end of tape 30 adjacent near end 38 of guideway 34 (see FIG. 1). Other frictional resistance, which generally is sufficient, is also provided by the resistance of tape 30 to be pulled out of its T-shaped slot in guideway 34. The tape 30 has been cut by cutter 33 prior to the time that leading end 37 contacts nip 29 so that only a definite short length of tape 30 is used in the web cutting, and the supply in spool 31 is not disrupted, but is kept for use when the next time comes to cut the web 20 going to spool 27 and transfer the web 20 to a new empty spool.

Figure 6:
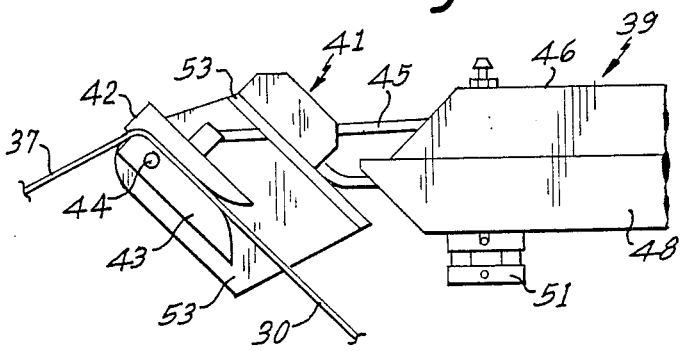
FIG. 6 is an enlarged view of a portion of the mechanical arm gripping the tape.
Figure 7:
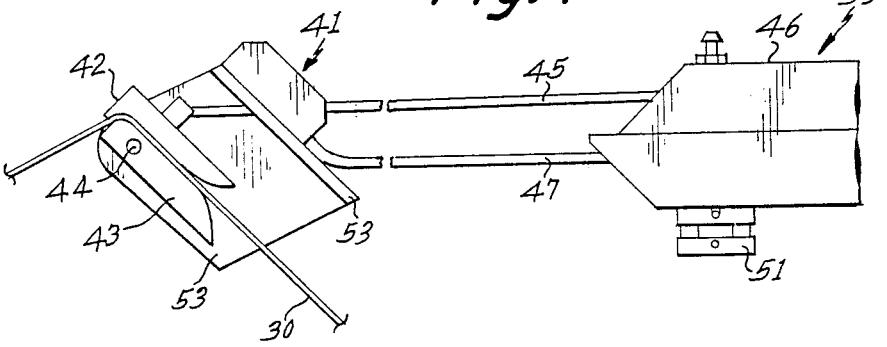
FIG. 7 is an enlarged view of the arm and tape of FIG. 6 extended forward.

In FIGS. 4–7 the details of the preferred embodiment of the mechanical arm 39 and clamping means 41 are shown. A pneumatic cylinder 54 in housing 46 is connected to a source of pressurized air through connection 49. Rod 45 is connected to the cylinder 54 in housing 46 and will extend outwardly or retract inwardly due to the pressurized air in the cylinder. As rod 45 moves outwardly it moves jaw 42 outwardly until it contacts and is stopped by clamping member 43 while elongated rod 47 is locked in place, as shown in FIG. 6. Tape 30 is gripped between jaw 42 and clamping member 43 to cause leading end 37 of tape 30 to project in front of clamping means 41. Clamping member 43 pivots about pin 44 as jaw 42 is pushed against clamping member 43 or is released therefrom. A pneumatic cylinder 51 operates a locking pin 52 which engages a notch 50 in rod 47. The movement of frame 53 is the last step in pushing leading end 37 of tape 30 into nip 29 of rolls 23 and 27. This movement of rod 47 is controlled by the release of pin 52 from engagement with a notch 50 in rod 47, by activating pneumatic cylinder 51. The retraction of pin 52 from notch 50 in rod 47 permits cylinder 54 to extend both rods 45 and 47 to their generally fully forward position where end 37 of tape 30 contacts nip 29. With both rods extended the tape 30 is easily removed laterally of clamping member 43 and jaw 42 without unusual or destructive forces being applied thereto. Cylinders 51 and 54 may be double acting or be single acting (with a spring return) as is known by those skilled in the art. After the frame 53 is returned to position shown in FIG. 5, cylinder 51 is activated (or spring returned) to cause pin 52 to lock within notch 50 of rod 47. An alternate clamping means is that shown in FIGS. 8–11. An angle support structure 55 extends outwardly from far end 36 of guideway 34. A motor 56 and gear box 57 provide the power to rotate knurled cylinder 58 mounted on shaft 59. Tape 30 moves forward between cylinder 58 and pivotable table 60 mounted in structure 55 until forward end 37 of tape 30 extends beyond table 60. Movement of tape 30 is then stopped by table 60 being pressed upward against cylinder 58 causing a large loop 61 of tape 30 to build up behind cylinder 58. Table 60 is pivoted about pin 62 by the upward movement of head 63 connected to a fluid operated cylinder 64. Table 60 moves from normal position 65 to upward position 66 where it presses tape 30 against cylinder 58 to stop forward movement of tape 30. When the operator wants to introduce leading end 37 into the nip 29 he causes cylinder 58 to rotate in the direction of arrow 68 against idler roller 67 in table 60 and thereby to advance leading end 37. When leading end 37 contacts nip 29 the tape 30 is pulled sidewise away from the clamping means and wrapped spirally around roll 27, cutting web 20 and starting the cut edge of web 20 to be rolled up onto spool 27.

There are a variety of means of applying adhesive to forward end 37 of tape 30 as specified particularly in my copending patent application No. D-5484A, filed concurrently herewith. The preferred features require that adhesive be applied to the one surface of forward end 37 which contacts empty spool 27 at nip 29. Another preferred feature is that the adhesive be applied to end 37 before tape 30 enters guideway 34 at near end 38, and that the surface of tape 30 having adhesive thereon face downwardly as it passes through guideway 34. Generally the amount of surface of forward end 37 which is coated with adhesive is relatively short, e.g., about 6 inches and is at the extreme end of forward end 37.

It is to be understood that the various components of this machine can be operated by power assisted means without departing from the scope or spirit of the invention. For example, an electric motor could be employed for the hand crank 35 and a solenoid or pneumatic cylinder and piston may be used to power the cutting means 33. In this manner a person can control the apparatus remotely from either side of travelling web 20.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. In a system for cutting with a tape a travelling web of paper being wound on a first spool and transferring that travelling web onto an empty spool by attaching said tape to said empty spool, said tape travelling slidingly through a guideway with an elongated slot facing upwardly underneath said web and exiting from said guideway beyond the edge of the web; the improvement which comprises clamping means for releasably gripping said tape adjacent the forward end thereof to prevent movement of the tape after said forward end has exited from said guideway and selectively releasing said tape to permit forward movement of said forward end into the nip between said empty spool and the cooperating roller driving said empty spool.

2. The system of claim 1 wherein said clamping means includes a movable supporting pad, a rotatable drive roller, and means to releasably press said pad against said roller with said tape therebetween.

3. The system of claim 2 wherein said means to releasably press is a fluid powered piston connected to said support pad so as to push said pad against said roller.

4. The system of claim 1 wherein said clamping means includes a movable jaw and a cooperating pivotable clamping member adapted to receive said tape therebetween.

5. The system of claim 4 wherein said clamping means includes a frame, pivot means for pivotally attaching said clamping member to said frame, a fluid powered piston means attached to said movable jaw for forcing said jaw against said clamping means to engage said tape therebetween, said positioning means including brake means for retaining said frame in its retracted position and for permitting movement of said frame into its forwardly extended position, where said tape contacts the nip between said empty spool and said cooperating roller.

6. The system of claim 5 wherein the said piston means is rigidly attached to a housing and includes a piston rod which passes freely through an opening in said frame and is attached at its forward end to said movable jaw; an elongated rod attached to said frame at one end thereof and having its opposite end disposed within a bore in said housing, said piston rod and said elongated rod being substantially parallel; said elongated rod having a notch therein located between said ends thereof, said positioning means including a retractable pin extending generally laterally of said elongated rod and having an end portion engagable in said notch, said pin being disengagable from said notch to permit said elongated rod and said frame to be extended forwardly by the force of said piston rod to said forwardly extended position.

7. The system of claim 4 wherein said clamping means includes a fluid powered piston connected to said movable jaw to forcibly engage said tape against said clamping member.

8. The system of claim 1 further comprising means for applying adhesive to said forward end of said tape before said tape travels through said guideway.

9. The system of claim 8 further comprising means for applying adhesive to the surface of said tape facing downwardly in said guideway, adjacent said forward end of said tape.

10. An improved method for cutting a travelling web of paper being wound on a spool and transferring the web after cutting to an empty spool, the method including a cutting tape being fed into an elongated guideway positioned beneath and extending laterally across the web of paper, recovering the tape from the far end of the guideway and introducing it into the nip of the empty spool and the roller driving that spool to cause the tape automatically to spirally wrap around the empty spool while cutting the web of paper; wherein the improvement comprises the steps of:

(1) feeding said tape into a guideway;

(2) receiving the tape leaving the far end of the guideway into a remotely controlled clamping means;

(3) gripping the tape near its forward end by said clamping means with said forward end extending beyond said clamping means; and (4) releasing said clamping means and moving said forward end of said tape into contact with said nip.

11. The method of claim 10 further comprising the step of:

(5) applying adhesive to the surface of said forward end of said tape which will contact said empty spool.

12. The method of claim 11 wherein said step (5) is performed before step (1).

13. The method of claim 11 wherein the adhesive of step (5) is applied to a bottom surface of said tape.

14. The method of claim 10 wherein said tape, after being caught in said nip, is automatically released from the grip of said clamping means.

* * * * *